United States Patent [19]

Cutlip

[11] Patent Number: 4,974,574

[45] Date of Patent: Dec. 4, 1990

[54] MULTIPLE DISC LAUNCHER

[76] Inventor: Jeffrey A. Cutlip, 6671 Shiloh Rd., Goshen, Ohio 45122

[21] Appl. No.: 439,141

[22] Filed: Nov. 20, 1989

[51] Int. Cl.[5] ..... F41B 3/04

[52] U.S. Cl. ..... 124/5; 124/43

[58] Field of Search ..... 124/5, 4, 42, 43, 81, 124/79

[56] References Cited

U.S. PATENT DOCUMENTS

| | | | |
|---|---|---|---|
| 831,365 | 9/1906 | Masel | 124/43 |
| 1,306,393 | 6/1919 | Sibley | 124/5 |
| 1,445,371 | 2/1923 | Vickery | 124/43 X |
| 1,607,874 | 11/1926 | Darton | 124/5 |
| 4,076,004 | 2/1978 | Huelskamp | 124/43 X |
| 4,730,595 | 3/1988 | Glass et al. | 124/42 X |

*Primary Examiner*—Peter M. Cuomo

*Attorney, Agent, or Firm*—Leon Gilden

[57] ABSTRACT

A multiple disc launcher arrangement includes a single handle and a plurality of spines directed longitudinally of said handle wherein a first spine is of a liner configuration, wherein a second spine is of an arcuate configuration, wherein each spine orthogonally mounts at forward terminal ends thereof respective "C" shaped heads. Each "C" shaped head defines a straight leg and an arcuate leg with a circular pocket defined therewithin. An elongate, continuous "U" shaped groove receives a disc therewithin. A modification of the instant invention includes a sleeve selectively joining a plurality of separate handles, wherein each separate handle is joined to a respective straight and arcuate spine. The sleeve includes a ribbed upper surface to enhance grasping thereof. A further modification includes a resilient leg sleeve selectively positionable about a forward terminal end of each arcuate leg of each head to alter resistance of the head to release a disc when hurled by an individual.

1 Claim, 4 Drawing Sheets

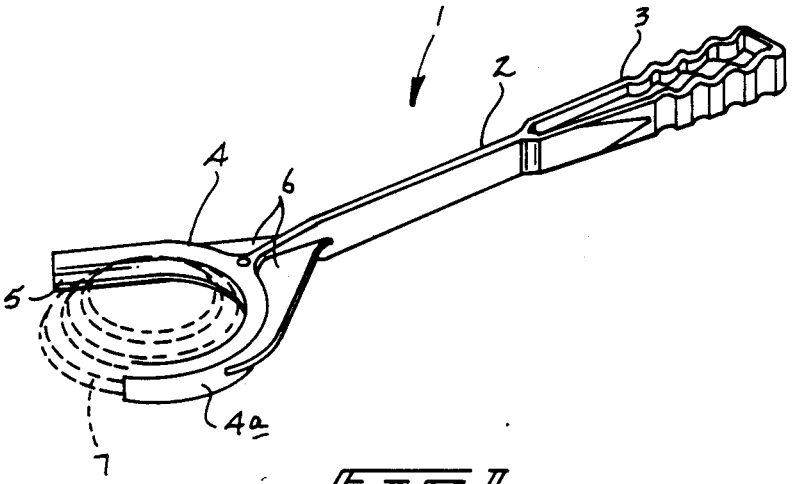
Fig 1
PRIOR ART
Fig 2
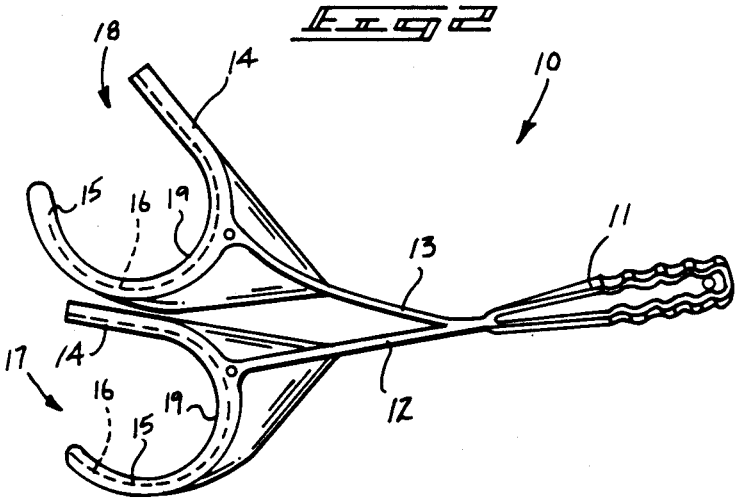

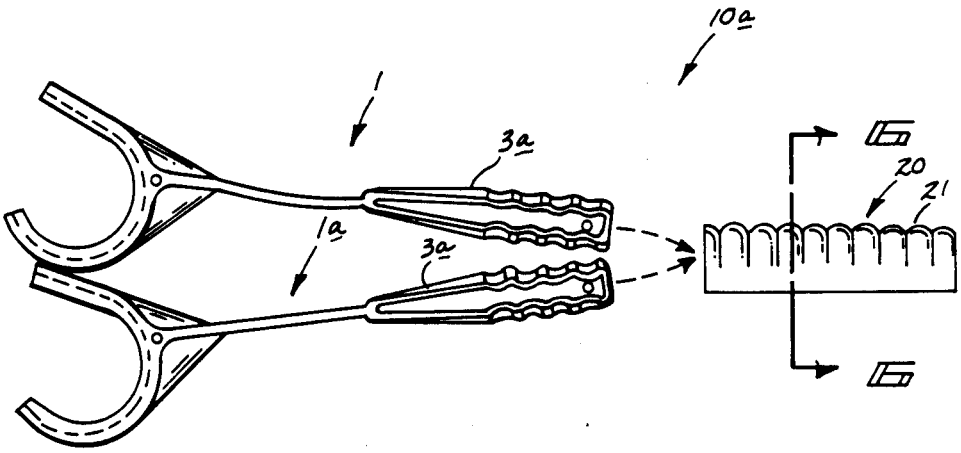
FIG 5
FIG 6
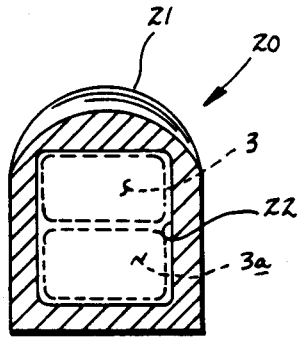

MULTIPLE DISC LAUNCHER

BACKGROUND OF THE INVENTION

1. Field of the Invention

The field of invention relates to disc throwers, and more particularly pertains to a new and improved multiple disc launcher wherein the same receives a plurality of discs associated with the games of skeet and trap to direct the discs in a parallel trajectory relative to one another.

2. Description of the Prior Art

Disc throwers for utilization in shooting sports, particularly the sports of skeet and trap, have been well utilized and known in the prior art. Several skeet and trap games employ multiple discs discharged simultaneously, but heretofore have necessitated the use of elaborate and complex mechanical throwers to effect such discharge. The instant invention attempts to overcome disadvantages of the prior art by presenting an economical and readily transportable multiple manually secured disc thrower to project a plurality of discs simultaneouslY. Examples of the prior art include U.S. Pat. No. 4,076,004 to Huelskamp illustrating the use of a unitarY launcher for disc type targets referred to as "clay pigeons" of conventional configuration.

U.S. Pat. No. 4,233,952 to Perkins sets forth a catapult device for use with target discs utilizing a pivoting head to enhance circulatory motion upon the projection of a target disc by an individual.

U.S. Pat. No. 3,901,208 to Laporte, et al., sets forth a disc type throwing device utilizing a planar plate member with a secondary leg member positioned at an acute angle relative to the plate member relative to a forward terminal end of the plate member, with a notched recess positioned to receive a target disc between the leg and the plate member.

U.S. Pat. No. 2,586,547 to Marley sets forth a hand trap for throwing a disc target defined as an elongate linear plate with a groove formed within each side of the plate to receive a disc between the grooves.

U.S. Pat. No. 4,730,595 to Glass, et al., sets forth a disc launcher of a molded construction with a symmetrical head member with a flexible arm extending from one side of the head member to receive a disc therebetween the arm and the head member.

As such, it may be appreciated that there is a continuing need for a new and improved multiple disc launcher as set forth by the instant invention which addresses both the problems of ease of use and the securement of multiple discs to accommodate specialized shooting game events, as well as effectiveness in construction, and in this respect, the present invention substantially fulfills this need.

SUMMARY OF THE INVENTION

In view of the foregoing disadvantages inherent in the known types of disc launchers now present in the prior art. the present invention provides a multiple disc launcher wherein the same securedly receives a plurality of discs for subsequent launch thereof in spaced trajectories. As such. the general purpose of the present invention, which will be described subsequently in greater detail, is to provide a new and improved multiple disc launcher which has all the advantages of the prior art disc launchers and none of the disadvantages.

To attain this, the present invention includes a single handle and a plurality of spines directed longitudinally of said handle wherein a first spine is of a linear configuration, wherein a second spine is of an arcuate configuration, wherein each spine orthogonally mounts at forward terminal ends thereof respective "C" shaped heads. Each "C" shaped head defines a straight leg and an arcuate leg with a circular pocket defined therewithin. A modification of the instant invention includes a sleeve selectively joining a plurality of separate handles, wherein each separate handle is joined to a respective straight and arcuate spine. The sleeve includes a ribbed upper surface to enhance grasping thereof. A further modification includes a resilient leg sleeve selectively positionable about& a forward terminal end of each arcuate leg of each head to alter resistance of the head to release a disc when hurled by an individual.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art ma be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multiple disc launcher which has all the advantages of the prior art disc launchers and none of the disadvantages.

It is another object of the present invention to provide a new and improved multiple disc launcher which may be easily and efficiently manufactured and marketed.

It is a further object of the present invention to provide a new and improved multiple disc launcher which is of a durable and reliable construction.

An even further object of the present invention is to provide a new and improved multiple disc launcher which is susceptible of a low cost of manufacture with regard to both materials and labor, and which accordingly is then susceptible of low prices of sale to the consuming public, thereby making such multiple disc launchers economically available to the buying public.

Still yet another object of the present invention is to provide a new and improved multiple disc launcher which provides in the apparatuses and methods of the prior art some of the advantages thereof, while simultaneously overcoming some of the disadvantages normally associated therewith.

Still another object of the present invention is to provide a new and improved multiple disc launcher wherein the same receives a plurality of discs within a single launch thrower to direct a plurality of discs in spaced trajectories.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art disc launcher.

FIG. 2 is a top orthographic view of a multiple disc launcher of the instant invention.

FIG. 5 is a modified disc launcher assembly utilizing a plurality of individual disc launchers and a securement sheath.

FIG. 6 is an orthographic view taken along the lines 6—6 of FIG. 5 in the direction indicated by the arrows.

FIG. 7 is a top orthographic view of a modified disc launcher utilized in the assembly, as illustrated in FIG. 5.

DESCRIPTION OF THE PREFERRED EMBODIMENT

Figure 3:
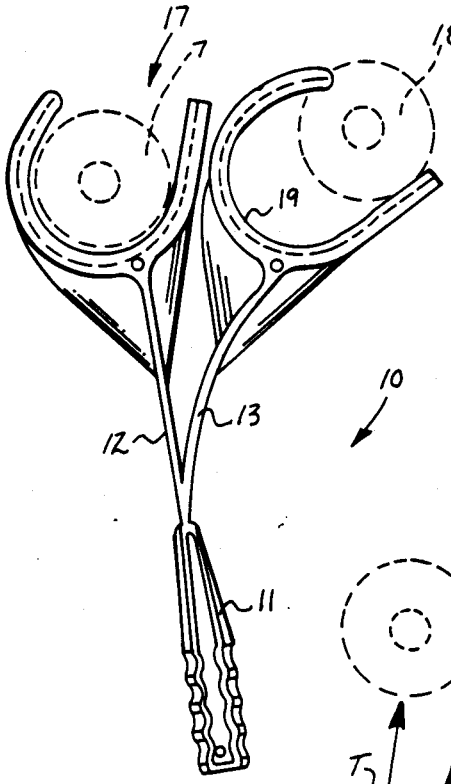
FIG. 3 is a top orthographic view of a multiple disc launcher of the instant invention in a loading configuration receiving target discs therewithin.

With reference now to the drawings, and in particular to FIGS. 1 to 8 thereof, a new and improved multiple disc launcher embodying the principles and concepts of the present invention and generally designated by the reference numerals 10 and 10*a* will be described.

More specifically, the multiple disc launcher 10 defines an improvement over the use of individual disc launchers 1, as illustrated in FIG. 1, wherein the disc launcher utilizes a support beam 2 with a handle 3 at a rearward terminal end thereof and a "C" shaped head at a forward terminal end thereof, wherein the "C" shaped head defines a straight leg 4 spaced from an arcuate leg 4*a* with a "U" shaped groove defined within the legs. A target disc 7 is receivable within the "U" shaped groove for subsequent launch.

FIG. 2 is illustrative of the multiple disc launcher 10 wherein a single unitary handle 11 integrally receives a first arcuate spine 12 spaced in alignment with a second straight spine 13. The spines 12 and 13 are of a generally semi-rigid construction to enable flexure such that when the associated respective first and second "C" shaped heads 17 and 18 are snapped by a manual manipulation of the device by an individual, the associated discs 7 received within the heads 17 and 18 are pitched in spaced trajectories relative to the device. The "C" shaped heads 17 and 18 are each connected to the respective spines 12 and 13 by reinforcing webs positioned between the heads and the spines to ensure alignment of the heads relative to the spine. Each of the heads include a first straight leg 14 spaced from an arcuate leg 15 with a "U" shaped groove coextensive with an interior surface of the respective heads 17 and 18, wherein the "U" shaped grooves 16 are in alignment relative to one another and defined by parallel flanges. The top and bottom surfaces of the first and second "C" shaped heads 17 and 18 are in alignment and parallel relative to one another. Further, the "C" shaped heads define circular pockets 19 at their innermost association of the straight and arcuate legs to receive the respective discs 7 therewithin.

Figure 4:
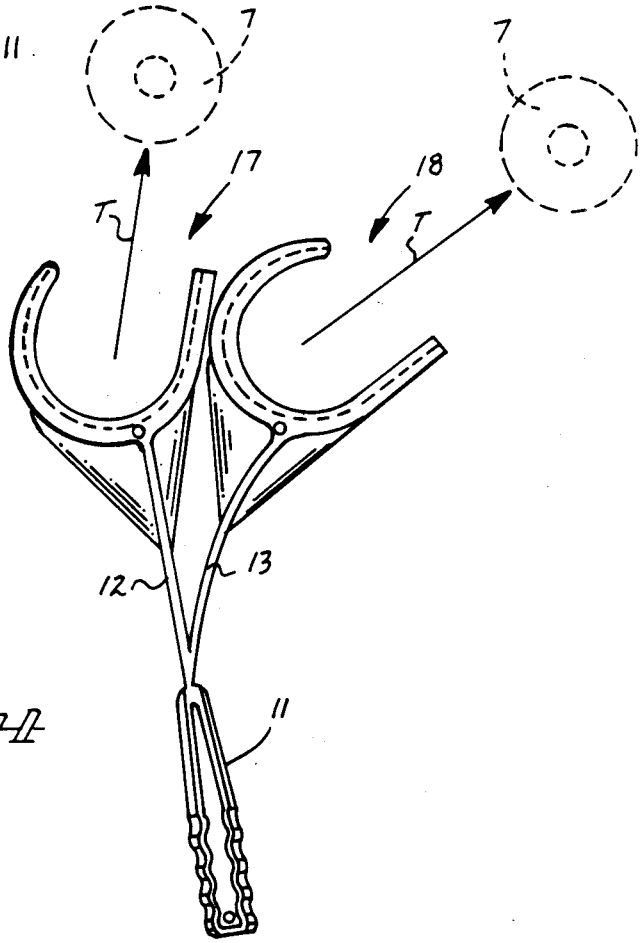
FIG. 4 is a top orthographic view of the instant invention during a multiple disc launch event.
Figure 11:
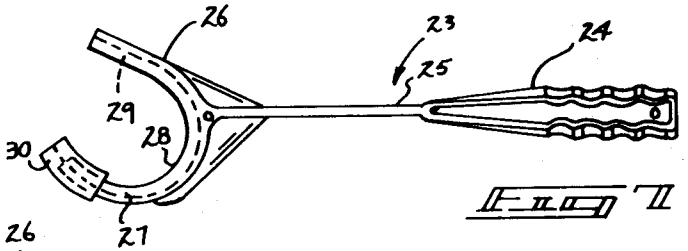

FIGS. 3 and 4 illustrate the respective loading and subsequent resultant trajectories of the associated target discs 7 when directed from the launcher 10. It should be noted that the combination of the arcuately oriented head 18 with the first "C" shaped head 17 is critical to the desired spacing of the resulting trajectories "T" when the targets 7 are thrown from the respective head.

FIG. 5 illustrates a modified multiple disc launcher 10 utilizing a plurality of individual disc launchers 1 and 1*a*. The disc launcher 1 utilizes an arcuate spine to position an angularly oriented "C" shaped head relative to the "C" shaped head of the disc launcher 1*a*. Essentially it is required that an arcuately oriented "C" shaped head be mounted in an aligned side by side relationship relative to a linearly oriented "C" shaped, as illustrated in FIG. 5. The respective handles 3 and 3*a* are received within a securement sheath 20. The sheath 20 includes an upper ribbed surface 21 to receive the handles 3 and 3*a* therewithin. The sheath 20 includes a central cavity 22 defining a geometric cavity complementary to that defined by the handles 3 and 3*a*.

Figure 8:
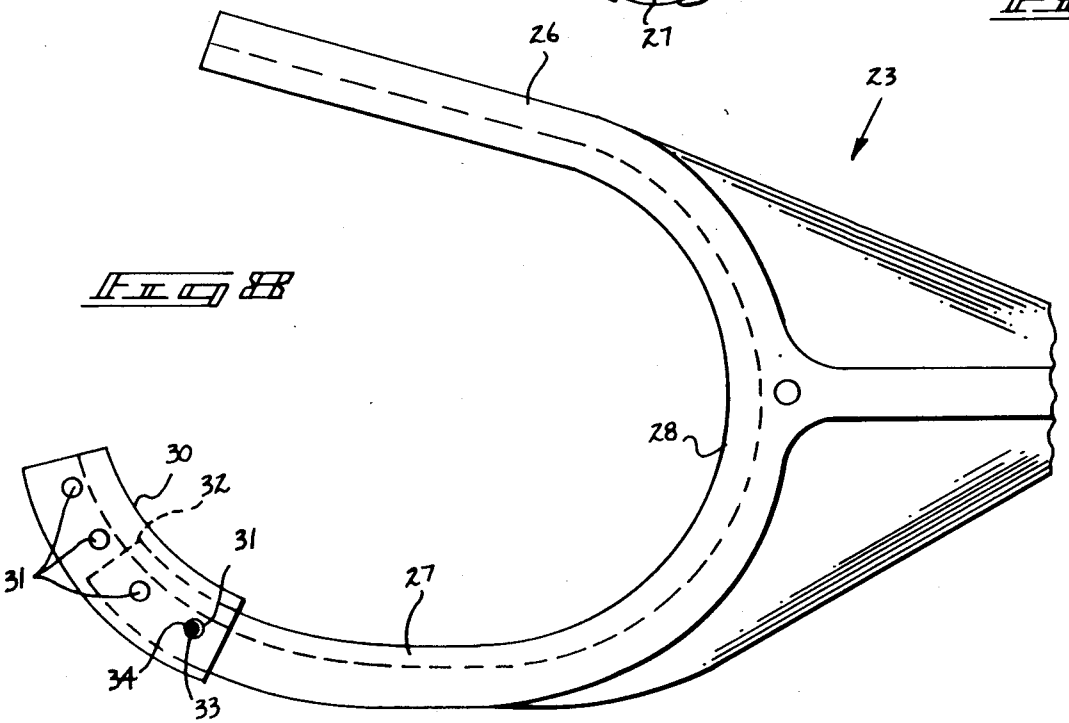
FIG. 8 is an enlarged top orthographic view of the head assembly of the disc launcher, as illustrated in FIG. 7.

FIGS. 7 and 8 illustrate a modified launcher 23 for use in a paired combination, as illustrated in FIG. 5 for example. For purposes of illustration, the modified launcher 23 utilizes a linearly aligned spine 25 mounting a forwardly positioned "C" shaped head, but it is understood that a further launcher 23 including an arcuate spine is utilized in a combination, as illustrated in FIG. 5. The launcher 23 includes a straight leg 26 spaced from an arcuate leg 27 that merge to define a circular pocket 28 to receive an associated disc. A "U" shaped groove 29 is mounted coextensively within interior surfaces of the "C" shaped head to receive an associated target disc. The arcuate leg 27 defines a forward terminal end 32 to receive a sleeve 30 formed of resilient construction. The sleeve 30 includes a series of spaced sleeve apertures 31 directed therethrough to receive a lock pin 33 that is directed through a selective one of the sleeve apertures 31 and received within a leg aperture 34 formed within the arcuate leg 27 orthogonally therethrough to selectively position the sleeve 30 to form an extension of the leg 27 to thereby modify the resistance encountered by a disc within the associated pocket 28, whereupon enhanced force is required to launch the disc and thereby modify its trajectory upon its escape from within the "C" shaped head defined by the straight leg 26, the arcuate leg 27, and the associated sleeve 30 extending forwardly of the forward terminal end 32 of the arcuate leg 27.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A target disc launcher apparatus for simultaneously and manually projecting a plurality of target discs, wherein said apparatus comprises, a unitary handle means for securing a first and second spine member longitudinally thereof, the first spine member defined by a straight linear configuration and the second spine member defined by an arcuate configuration, and the first and second spine members each integrally mounting a respective first and second head member thereon at a forward terminal end of each first and second spine members, and wherein the first and second head members each include upper and lower surfaces, the upper and lower surfaces of each head member in an aligned parallel relationship relative to one another, and each head member defining a straight leg and an arcuate leg defining a "C" shaped configuration, wherein the "C" shaped configuration includes a circular pocket at a rearwardmost end of the "C" shaped configuration and further defines a continuous "U" shaped groove within a continuous interior surface of the first and second leg members, and wherein the unitary handle means is defined as a sheath portion, the sheath portion including a side portion of a ribbed configuration for enhanced manual grasping thereof, and further including an elongate cavity of a generally parallelepiped configuration therewithin, and wherein the first and second spine members each terminals at their rearward ends in a first and second handle, the first and second handles are slidably received within the cavity of the sheath member, and wherein the first and second handles define an external configuration complementary to that defined by the cavity, and wherein each arcuate leg includes a leg aperture directed orthogonally therethrough spaced from the "U" shaped channel, and further including a resilient sleeve slidably mounted on the arcuate leg and extending forwardly of the arcuate leg, and wherein the sleeve includes a plurality of sleeve apertures directed therethrough, and further including a lock pin directed selectively through one of the sleeve apertures and through the arcuate leg aperture to selectively secure the sleeve relative to the arcuate leg.

* * * * *